US010266359B2

(12) United States Patent
Christensen

(10) Patent No.: US 10,266,359 B2
(45) Date of Patent: Apr. 23, 2019

(54) APPARATUS AND METHOD FOR WEB TRANSFER WITH AN AIRGUIDE

(71) Applicant: PEROMO LTD, Gorey (IE)

(72) Inventor: Per Christensen, Gorey (IE)

(73) Assignee: PEROMO LTD, Gorey (IE)

( * ) Notice: Subject to any disclaimer, the term of this patent is extended or adjusted under 35 U.S.C. 154(b) by 164 days.

(21) Appl. No.: 15/106,520

(22) PCT Filed: Dec. 22, 2014

(86) PCT No.: PCT/EP2014/079097
§ 371 (c)(1),
(2) Date: Jun. 20, 2016

(87) PCT Pub. No.: WO2015/092078
PCT Pub. Date: Jun. 25, 2015

(65) Prior Publication Data

US 2017/0001823 A1 Jan. 5, 2017

(30) Foreign Application Priority Data

Dec. 20, 2013 (IE) ..... S2013/0389

(51) Int. Cl.
*B65H 19/22* (2006.01)
*B65H 19/26* (2006.01)
(Continued)

(52) U.S. Cl.
CPC ..... *B65H 19/28* (2013.01); *B65H 19/2238* (2013.01); *B65H 19/26* (2013.01);
(Continued)

(58) Field of Classification Search
CPC .... B65H 19/26; B65H 19/28; B65H 19/2238; B65H 2406/12; B65H 2301/4461; B65H 2301/4176
(Continued)

(56) References Cited

U.S. PATENT DOCUMENTS 3,501,104 A * 3/1970 Hellemans ..... B29C 53/32 242/527.4
3,844,189 A 10/1974 Jardine
(Continued)

FOREIGN PATENT DOCUMENTS

EP 0697007 11/1998
GB 2009108 6/1979
(Continued)

OTHER PUBLICATIONS

International Preliminary Report on Patentability dated May 20, 2016.
(Continued)

*Primary Examiner* — William E Dondero
(74) *Attorney, Agent, or Firm* — Preston Smirman; Smirman IP Law, PLLC

(57) ABSTRACT

An assembly for entraining a cut end of a web in a fluid flow, the assembly comprising an arrangement for delivering a fluid flow proximal to an entrainment region where a web is cut. The assembly further has an arrangement for guiding the fluid flow and the entrained end of the web from the web entrainment region to a web delivery region.

20 Claims, 8 Drawing Sheets

(51) Int. Cl.
*B65H 19/28* (2006.01)
*B65H 23/24* (2006.01)

(52) U.S. Cl.
CPC ..... *B65H 23/24* (2013.01); *B65H 2301/4176* (2013.01); *B65H 2301/4461* (2013.01); *B65H 2406/12* (2013.01)

(58) Field of Classification Search
USPC ..... 242/532.2
See application file for complete search history.

(56) References Cited

U.S. PATENT DOCUMENTS

| | | | | |
|---|---|---|---|---|
| 5,383,622 | A * | 1/1995 | Kohler ..... | B65H 19/283<br>242/527.2 |
| 2003/0025028 | A1 | 2/2003 | Drefs et al. | |

FOREIGN PATENT DOCUMENTS

| | | |
|---|---|---|
| WO | 9105725 | 10/1990 |
| WO | 9928277 | 6/1999 |

OTHER PUBLICATIONS

International Search Report dated May 7, 2015.
Written Opinion of the International Searching Authority dated May 7, 2015.
Written Opinion of the International Preliminary Examining Authority dated Feb. 8, 2016.

* cited by examiner

APPARATUS AND METHOD FOR WEB TRANSFER WITH AN AIRGUIDE

CROSS-REFERENCE TO RELATED APPLICATION

The instant application is a national phase of PCT International Application No. PCT/EP2014/079097 filed Dec. 22, 2014, and claims priority to IE Patent Application Serial No. S2013/0389 filed Dec. 20, 2013, the entire specifications of both of which are expressly incorporated herein by reference.

The present invention relates to an apparatus and method for the transfer of a web and in particular to an apparatus and method for the automatic transfer of a web from one core/shaft to another core/shaft.

The existing process and apparatus for automatic web transfer involves a film web winding onto a film roll on a continuous film winder. The web is cut and the incoming web is transferred onto a new core. Film web manufacturers use many types of web transfer systems for transferring a web onto a new core or shaft. These can range from, but not limited to, adhesive tape wrapped onto new core, glue applied to new core, electrostatic transfer, air nozzles engaging web onto new core. Systems that use consumables, e.g. tape or glue are not always reliable. The properties of the adhesive tape or glue can change with ambient conditions, e.g. temperature and humidity. Another major problem with this type of transfer technology occurs where the cut off web does not engage with the new core. Furthermore, it may not be desirable to have adhesive tape or glue attached on the core or web as it increases the complexity and/or cost of recycling. Additionally, the cores are not easily reusable with remnants of glue or adhesive from a previous use.

The known systems that use electrostatic discharge or air nozzles are not always reliable and the end of the cut off web may not engage with the new core where electrostatic discharge or air nozzle technology are used. As flexible webs are often produced in a continuous manner, a web transfer not engaging with a new core or shaft can lead to a wrap-around. This is hugely undesirable for the plant with the web production line being halted and then re-started. It can lead to significant waste material and lost production time. The manufacturers would prefer an alternative more reliable method for web transfer.

It is an object of the present invention to obviate or mitigate the problems of undesirable consumables such as glue/tape for use with transfer of cut web as well as the problem of wrap around inherent with existing ineffective transfer technology.

Accordingly, the present invention provides an assembly for entraining a cut end of a web in a fluid flow, the assembly comprising means for delivering a fluid flow proximal to an entrainment region where a web is cut, the assembly further comprising means for guiding the fluid flow and the entrained end of the web from the web entrainment region to a web delivery region.

Advantageously, the cut end of the web is immediately entrained in a controllable fluid flow in the entrainment region and moved in a predetermined path allowing control over the movement and location of the cut end of the web. This prevents any inadvertent wrap-around of the cut end of the web after cutting of the web.

Ideally, the fluid flow is a high speed gas flow.

Preferably, the fluid is a compressed fluid for providing a high speed fluid flow.

Alternatively, the fluid is a fluid impelled at high speed by an impeller.

Ideally, the fluid is air.

Ideally, the means for guiding the fluid flow and the entrained end of the web comprises a fluid flow guide member.

Preferably, the fluid flow guide member having a surface, at least initially extending away from the uncut web in the same or similar direction as the direction of the flow of the fluid.

Preferably, the fluid flow guide member comprises at least one panel or sheet.

Ideally, the fluid flow guide member extends laterally along all or part of the width of the web.

Preferably, the fluid flow guide member may comprise a plurality of panels or sheet side by side extending laterally along all or part of the width of the web.

Ideally, the cut web delivery region is a replacement web collection means.

Preferably, the replacement web collection means is a replacement shaft and/or core.

Ideally, the forward portion of the fluid flow guide member proximal to the leading edge of the fluid flow guide member is planar.

Preferably, the leading edge of the fluid flow guide member is proximal to the entrainment region.

Ideally, the aft portion of the fluid flow guide member proximal to the trailing edge of the fluid flow guide member is non planar.

Preferably, the trailing edge of the fluid flow guide member is proximal to the web delivery region.

Ideally, the aft portion of the fluid flow guide member is curved.

Preferably, the aft portion of the fluid flow guide member is arcuate.

Ideally, the aft portion of the fluid flow guide member is part cylindrical. Advantageously, the aft portion of the fluid flow guide member being curved, preferably arcuate and most preferably part cylindrical allows the aft portion to follow the circumference of the outer surface of a replacement web collection means for collecting the cut end of the web being dispensed. The replacement web collection means being a replacement core or shaft having a generally cylindrical body.

Preferably, the fluid flow guide member is mounted proximal to the replacement web collection means for collecting the cut end of the web in a web cutting operational position.

Ideally, the fluid flow guide member is mounted less than 20 mm from the replacement web collection means in the web cutting operational position.

Preferably, the fluid flow guide member is mounted less than 10 mm from the replacement web collection means in the web cutting operational position. In certain winder systems, especially larger winder systems, the replacement core and/or shaft may undergo slight movement in use, so the overall distance that the flow guide member is set at relative to the replacement core and/or shaft must compensate for this potential movement. In smaller winder systems, the overall distance that the flow guide member is set at relative to the replacement core and/or shaft can be reduced as there is less risk of movement of the replacement core and/or shaft in these smaller systems.

Ideally, the cross section of the fluid flow guide member has a j-shape. It will of course be appreciated that other shapes can be used.

Preferably, the surface of the fluid flow guide member is substantially smooth.

Ideally, where the fluid flow guide member is steel, the surface is sanded.

Preferably, where the fluid flow guide member is aluminium, the surface is brushed.

Ideally, the smooth surface of the fluid flow guide member provides a laminar flow fluid flow with a boundary layer. Advantageously, this laminar flow with a boundary layer prevents the web cut end and the following web from coming into contact with the surface of the fluid flow guide member.

Preferably, the end of the fluid flow guide member has a sharp edge. Advantageously, this sharp edge creates a separation of the airflow which prevent the cut end of the web tending to wrap around the sharp end and/or being drawn away from the replacement web collection means. It is believed that the boundary layer separating and accelerating away from this sharp end creates a further venturi effect here which urges the cut end of the web towards the replacement shaft and/or core to supplement the coanda effect.

Ideally, the replacement web collection means being disposed in the fluid flow and having a curved surface creates a coanada effect on the fluid flow drawing this layer of fluid flow towards the curved surface of the replacement web collection means. Advantageously, this coanda effect further enhances the technical functionality of the web entraining assembly to ensure the cut end of the web is urged towards the replacement web collection means.

Ideally, the fluid flow guide member is manufactured from any suitable metal or metal alloy such as aluminium or steel.

Alternatively, the fluid flow guide member is manufactured from a plastic or any composite material. The fluid flow guide member can be manufactured from any material provided the material is capable of withstanding the forces generated by the fluid flow.

Preferably, the means for delivering a fluid flow proximal to the entrainment region where a web is cut comprises a fluid knife.

Ideally, the means for delivering a fluid flow proximal to the entrainment region where a web is cut comprises a reservoir for holding a volume of fluid.

Preferably, the fluid flow delivery means comprises fluid outlet means in fluid communication with the reservoir and the entrainment region.

Ideally, the fluid flow delivery means comprises means for urging the fluid from the reservoir out through the fluid outlet means.

Preferably, the urging means comprises a vessel of pressurized fluid in fluid communication with the reservoir.

Ideally, the urging means is in fluid communication with the reservoir via one or more conduits and one or more valve means.

Alternatively, the urging means comprises a compressor in fluid communication with the reservoir.

In this embodiment, the urging means is in fluid communication with the reservoir via one or more conduits and one or more valve means.

Ideally, the fluid outlet means is located proximal to the leading edge of the fluid flow guide member.

Preferably, the fluid outlet means is adapted to direct the fluid along the fluid flow guide member in a direction along the planar portion towards the curved aft portion.

Ideally, the fluid outlet means comprise one or more slots or slits or gaps or vents or valves.

Most preferably, the fluid outlet means comprises an elongated slit extending laterally along the length of the fluid flow delivery means. Advantageously, the elongated slit allows a laminar fluid flow to be initiated proximal to the fluid flow guide member in the direction towards the aft portion of the fluid flow guide member.

Most preferably, the fluid outlet means has no interruptions along its length.

Ideally, the width or cross sectional area of the opening providing the fluid outlet means is determined by any one of or any combination of the web thickness, web material, speed of web, size of core, the dimensions of the fluid flow delivery means and/or the dimensions of the fluid flow guide member.

Preferably, the width of the gap/opening providing the fluid outlet means is constant along the width of the reservoir Ideally, the width of the gap/opening providing the fluid outlet means is in the range of 0.02 mm to 4 mm.

In one working embodiment, the width of the gap/opening of the fluid outlet means is 0.05 mm. In this embodiment, the film is a 20 μm LLDPE film with polyisobutene (PIB). The core used is a 77 mm diameter cylindrical core and the web speed is 80 meters per minute. Three 750 mm long webs are running alongside one another.

Ideally, the working pressure or speed of the fluid is selected based on any one of or any combination of the web thickness, web material, speed of web, size of core, the dimensions of the fluid flow delivery means and/or the dimensions of the fluid flow guide member and/or the distance position of the assembly relative to the fluid outlet means.

In one embodiment, the pressure of the fluid is any pressure up to and including 7 bar.

Alternatively, the fluid flow is delivered by ventilators and/or blowers where a lower pressure is sufficient.

Preferably, the fluid outlet means are spaced apart laterally along the width of the web to be cut.

Ideally, the fluid outlet means is located proximal to the web in the web cutting operational position.

Preferably, the fluid outlet means is located a distance in the range of 0.1 mm to 40 mm from the web in the web cutting operational position. The distance is selected to suit the specific application to obtain the strongest venturi effect and avoid scraping the plastic web.

Ideally, the fluid outlet means is located proximal to the cutting position of the web.

Preferably, the fluid outlet means is located upstream of the cutting position of the web relative to the direction of flow of the web prior to cutting.

Ideally, the fluid outlet means delivers a laminar flow of fluid along the fluid flow guide member.

Preferably, the fluid flow exiting the fluid outlet means creates a venturi effect on the ambient air around the entrainment region by drawing the ambient air into the flow of fluid being delivered along the fluid flow guide means. The higher speed fluid flow creates a suction on the ambient air in the entrainment region thereby further enhancing the technical function of the entrainment assembly to ensure that the cut end of the web is entrained in the overall airflow in the entrainment region. This prevents any risk of wrap around which is the major potential problem when the web is cut during replacement of a shaft and/or core.

Preferably, the fluid flow delivery means extends laterally along all or part of the width of the web.

Preferably, the fluid outlet means extends laterally along all or part of the width of the web.

Ideally, the fluid flow delivery means comprises a reservoir for temporarily housing the fluid for forming the fluid flow.

Preferably, the reservoir comprises an elongate housing defining a fluid chamber extending laterally transverse the web.

Ideally, the elongate housing comprises a tubular body having at least one opening for defining the fluid outlet means.

Preferably, the elongate housing comprises an open tubular body where the open ends of the tubular wall form an overlap defining a gap there between for defining the fluid outlet means.

Ideally, walls of the opening of the tubular body create a channel for aligning the outlet direction of the fluid flow with the surface of the fluid flow guide member.

Ideally, a single assembly for entraining a cut end of a web in a fluid flow is capable of extending longitudinally along the length of the path of the entrained web from the web entrainment region to a web delivery region.

In an alternative arrangement, two or more assemblies for entraining a cut end of a web in a fluid flow are provided spaced apart along the length of the path of the entrained web from the original web entrainment region to one or more further web entrainment regions to the web delivery region. In this embodiment, the one or more further assemblies are located relative to the first assembly to ensure the fluid flow is essentially continuous.

Ideally, the assembly for entraining a cut end of a web in a fluid flow is movably mountable relative to a film winder assembly.

Preferably, the assembly for entraining a cut end of a web in a fluid flow is movable pivotally, laterally, in articulation or in any other way relative to the film winder assembly.

Ideally, the winder assembly comprises a driven drum roller, a lay on idle roller and a first idle core and/or shaft.

Preferably, the first idle core and/or shaft and the lay on idle roller are driven by the drum roller.

Optionally, a web lift idle roller is insertable into the winder assembly for lifting the web off the driven drum roller for cutting of the web.

In an alternative assembly, the web is liftable off the driven drum roller by the venturi effect created by the fluid flow delivery means for cutting of the web.

Ideally, the winder assembly comprises knife means for cutting the web.

Preferably, the knife means comprises a flying knife. Alternatively, the knife means comprises a saw knife. Advantageously, the saw knife presents less of a health and safety risk.

In one embodiment, the assembly for entraining a cut end of a web in a fluid flow is mountable on the knife means.

In this embodiment, one or both of the fluid flow delivery means and the fluid guiding means are mountable on the knife means.

Ideally, the winder assembly is any one of or any combination of a turret winder assembly, a rewinder assembly, a centre winder assembly or a surface winder assembly.

Ideally, the assembly for entraining a cut end of a web in a fluid flow is operably coupled to control means.

Ideally, the control means comprises means for controlling one or more or any combination of the urging means, the valve means and the knife means.

Preferably, the control means comprises means for controlling the timing of the valve means relative to the control of the knife means.

Preferably, the control means comprises means for initiating the valve means at the same time or a short time prior to initiation of the knife means.

Ideally, the control means comprises means for initiating the valve means a few milliseconds prior to initiation of the knife means.

Ideally, the control means is an electronic control means.

Preferably, the electronic control means comprises PLC control.

The skilled man will appreciate that all preferred or optional features of the invention described with reference to only some aspects or embodiments of the invention may be applied to all aspects of the invention.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

The invention will now be described with reference to the accompanying drawings which shows by way of example only one embodiment of an apparatus in accordance with the invention. In the drawing.

Figure 7:
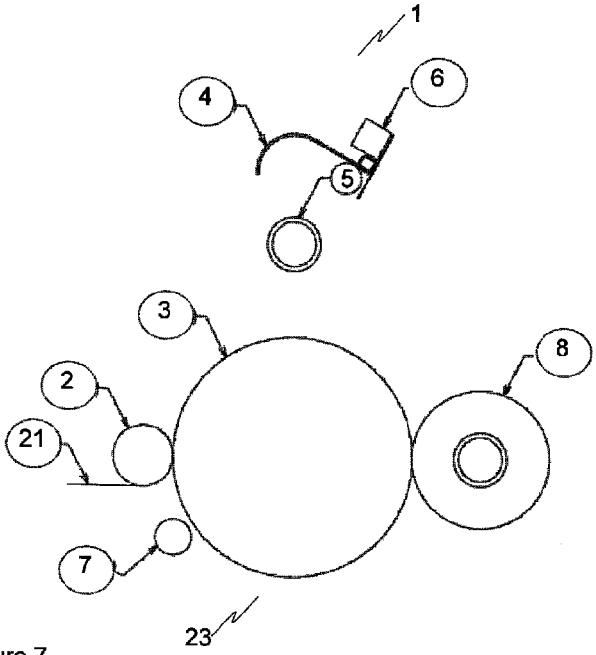
FIG. 7 illustrates a schematic side view of a first stage of the changeover process for winder cores/shafts using the entraining assembly of the present invention.
Figure 8:
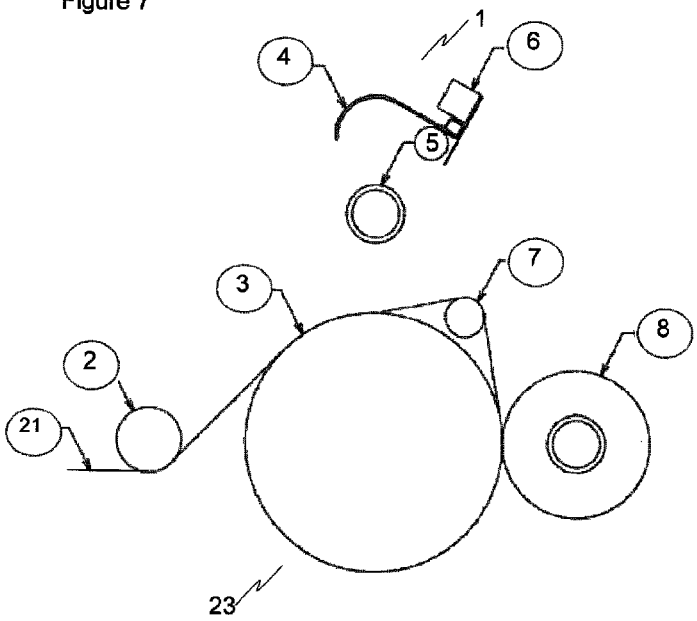
FIG. 8 illustrates a schematic side view of a second stage of the changeover process for winder cores/shafts using the entraining assembly of the present invention.
Figure 11:
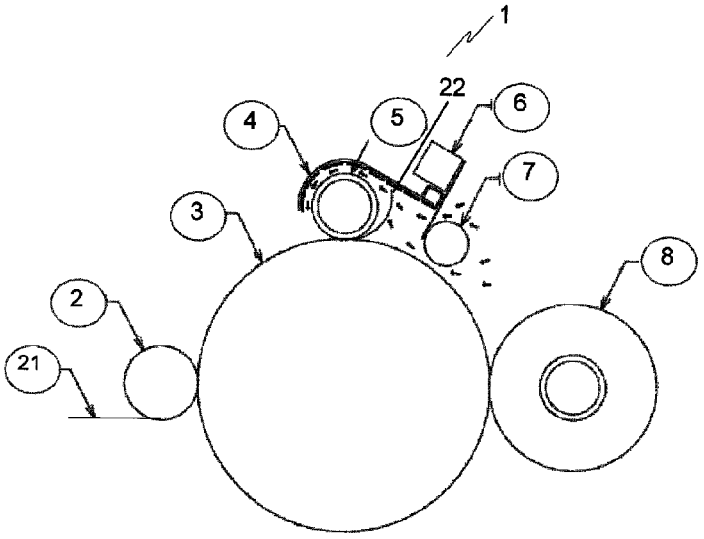
FIG. 11 illustrates a schematic side view of a fifth stage of the changeover process for winder cores/shafts using the entraining assembly of the present invention.

Referring to the drawings generally, there is shown an assembly indicated generally by the reference numeral 1 for entraining a cut end of a web 22 see FIG. 11 in a fluid flow 9, 10 movably mountable relative to a film winder assembly indicated generally by the reference numeral 23, see especially FIGS. 7 and 8 for clarity. The assembly 1 for entraining a cut end of a web 22 in a fluid flow 9, 10 is movable pivotally, laterally, in articulation or in any other way relative to the film winder assembly 23 to allow the assembly 1 to be moved into and out of an operational position to effect the changeover. The movement of the entrainment assembly 1 will be determined by the various bespoke operating conditions of the various film winder assemblies 23 found in various plants. The winder assembly 23 has a driven drum roller 3, a lay on idle roller 2 and a first core and/or shaft 8 with a full roll of web 21 wound thereon. The first core and/or shaft 8 and the lay on idle roller 2 are driven by the drum roller 3. A web lift idle roller 7 is optionally insertable into the winder assembly 23 for lifting the web 21 off the driven drum roller 3 for cutting of the web 21.

In an alternative assembly not shown in the drawings, the web 21 is liftable off the driven drum roller 3 by the venturi effect created by the fluid flow delivery arrangement for cutting of the web 21.

The winder assembly 23 comprises a flying knife arrangement 6 for cutting the web 21. Alternatively, the knife may be a saw knife. Advantageously, the saw knife presents less of a health and safety risk due to the limited movement compared to the high speed flying knife 6.

The assembly 1 for entraining a cut end of a web 22 in a fluid flow 9, 10 has an arrangement 11 for delivering a fluid flow proximal to an entrainment region where a web 21 is cut. The assembly 1 further has an arrangement 13 for guiding the fluid flow 9, 10 and the entrained end of the web 22 from the web entrainment region to a web delivery region namely onto the replacement shaft and/or core 5. Advantageously, the cut end of the web 22 is immediately entrained in a controllable fluid flow 9, 10 in the entrainment region and moved in a predetermined path allowing control over the movement and location of the cut end of the web 22. This prevents any inadvertent wrap-around of the cut end of the web 22 after cutting of the web 21. The fluid flow 9, 10 is a high speed fluid flow. The fluid is a compressed fluid for providing a high speed fluid flow 9, 10. Alternatively, the fluid is a fluid impelled at high speed. In the embodiment illustrated in the drawings, the fluid is air although other gases may be used such as ionized air.

The arrangement 13 for guiding the fluid flow 9, 10 and the entrained end of the web 22 comprises a fluid flow guide member 13. The fluid flow guide member 13 has an internal surface see FIGS. 3 and 5, at least initially extending away from the uncut web 21 in the same or similar direction as the direction of the flow of the fluid 9, 10. The fluid flow guide member 13 comprises two panels or sheets 15 as shown in FIG. 6 mounted relative to one another so as to create a continuous fluid flow 9, 10 or a single panel or sheet 16 as shown in all the other drawings in the longitudinal direction of fluid flow. The fluid flow guide member 13 extends laterally along all or part of the width of the web 21. The fluid flow guide member 13 may comprise a plurality of panels or sheets 15, 16 side by side extending laterally along all or part of the width of the web 21.

The cut web delivery region is a replacement web collection shaft and/or core 5. The forward portion 17, see FIGS. 3 and 5 of the fluid flow guide member 13 proximal to the leading edge 19 of the fluid flow guide member 13 is planar. The leading edge 19 of the fluid flow guide member 13 is proximal to the entrainment region. The aft portion 18 of the fluid flow guide member 13 proximal to the trailing edge 20 of the fluid flow guide member 13 is non planar. The trailing edge 20 of the fluid flow guide member 13 is proximal to the web delivery region. The aft portion 18 of the fluid flow guide member 13 is curved, preferably arcuate and as illustrated part cylindrical. Advantageously, the aft portion 18 of the fluid flow guide member 13 being curved, preferably arcuate and most preferably part cylindrical allows the aft portion 18 to follow the circumference of the outer surface of a replacement core and/or shaft 5 for collecting the cut end of the web 22 being dispensed. The replacement core and/or shaft 5 having a generally cylindrical body.

The fluid flow guide member 13 is mounted proximal to the replacement core and/or shaft 5 for collecting the cut end of the web 22 in a web cutting operational position as shown in FIGS. 1, 2, 4, 6, 10 and 11. The fluid flow guide member 13 is mounted a distance between 5 and 20 mm from the replacement core and/or shaft 5 in the web cutting operational position. The cross section of the fluid flow guide member 13 has a j-shape in the embodiment illustrated. The surface 14 of the fluid flow guide member 13 is substantially smooth. The smooth surface 14 of the fluid flow guide member 13 provides the conditions for a laminar flow fluid flow 10 with a boundary layer. Advantageously, this laminar flow 10 with a boundary layer prevents the web cut end 22 and the following web 21 from coming into contact with the surface 14 of the fluid flow guide member 13.

The end 20 of the fluid flow guide member 13 has a sharp edge. Advantageously, this sharp edge creates a separation of the airflow which prevents the cut end of the web 22 tending to wrap around the sharp end 20 and/or being drawn away from the replacement core and/or shaft 5. The replacement core and/or shaft 5 being disposed in the fluid flow 9 and the replacement core/shaft 5 having a curved surface creates a coanada effect on the fluid flow 9 drawing this layer of fluid flow 9 towards the curved surface of the replacement core/shaft 5. Advantageously, this coanda effect further enhances the technical functionality of the web entraining assembly 1 to ensure the cut end of the web 22 is urged towards the replacement core/shaft 5. The fluid flow guide member 13 is manufactured from any suitable metal or metal alloy such as aluminium or steel. Alternatively, the fluid flow guide member 13 is manufactured from a plastic or any composite material such as GRP. The fluid flow guide member 13 can be manufactured from any material provided the material is capable of withstanding the forces generated by the fluid flow 9, 10.

The arrangement 11 for delivering a fluid flow 10 proximal to the entrainment region where a web 21 is cut comprises a gas knife 11. The arrangement 11 for delivering a fluid flow 10 proximal to the entrainment region where a web 21 is cut has a reservoir 24, see FIGS. 3 and 5 for holding a volume of fluid, at least temporarily. The fluid flow delivery arrangement 11 has a fluid outlet 12 in fluid communication with the reservoir 24 and the entrainment region. By entrainment region we mean the area surrounding the point where the knife 6 cuts the web 21 best illustrated in FIG. 4. The fluid flow delivery arrangement 11 has an urging arrangement 31 see FIG. 3 urging the fluid from the reservoir 24 out through the fluid outlet 12. The urging arrangement 31 is a vessel of pressurized fluid 31 in fluid communication with the reservoir 24. The urging arrangement 31 is in fluid communication with the reservoir 24 via one or more conduits 32 and one or more valves 33 such as quick acting valves 33 to allow the pressurized fluid to enter the reservoir 24 at a predetermined time.

Alternatively, the urging arrangement comprises a compressor 31 in fluid communication with the reservoir 24. In this embodiment, the urging arrangement 31 is in fluid communication with the reservoir 24 via one or more conduits 32 and one or more valves 33. The fluid outlet 12 is located proximal to the leading edge 19 of the fluid flow guide member 13. The fluid outlet 12 is adapted to direct the fluid 10 along the fluid flow guide member 13 in a direction along the planar portion 17 towards the curved aft portion 18. The fluid outlet 12 comprises one or more slots or slits or gaps or vents or possibly valves, again controlled. Most preferably, the fluid outlet 12 comprises an elongated slit 12 extending laterally along the length of the fluid flow delivery arrangement 11 without interruption. Advantageously, the elongated slit 12 allows a laminar fluid flow 10 to be initiated proximal to the fluid flow guide member 13 in the direction towards the aft portion 18 of the fluid flow guide member 13.

The width or cross sectional area of the opening providing the fluid outlet 12 is determined by any one of or any combination of the web thickness, web material, speed of web, size of core, the dimensions of the fluid flow delivery arrangement 11 and/or the dimensions of the fluid flow guide member 13 and/or the position distance of the assembly. The width of the gap/opening 12 providing the fluid outlet 12 is constant along the width of the reservoir 24. The width of the gap/opening 12 providing the fluid outlet 12 is in the range of 0.02 mm to 4 mm.

In one working embodiment, the width of the gap/opening 12 of the fluid outlet 12 is 0.05 mm. In this embodiment, the film is a 20 μm LLDPE film with polyisobutene (PIB). The core used is a 77 mm diameter cylindrical core and the web speed is 80 meters per minute. Three 750 mm long webs are running alongside one another in this specific embodiment.

The pressure or speed of the fluid selected is variable depending upon any one of or any combination of the web thickness, web material, speed of web, size of core, the dimensions of the fluid flow delivery arrangement 11 and/or the dimensions of the fluid flow guide member 13. The pressure of the fluid is any pressure up to and including 7 bar although this is given as exemplary only. The fluid outlet 12 is located proximal to the web 21 in the web cutting operational position. The fluid outlet 12 is located a distance in the range of 0.1 mm to 40 mm from the web 21 in the web cutting operational position. The distance is selected to suit the specific application to obtain the strongest venturi effect and avoid scraping the plastic web 21.

The fluid outlet 12 is located proximal to the cutting position of the web 21 upstream of the cutting position of the web 21 relative to the direction of flow of the web 21 prior to cutting.

The fluid outlet 12 delivers a laminar flow of fluid 10 along the fluid flow guide member 13. The fluid flow 10 exiting the fluid outlet 12 creates a venturi effect on the ambient air around the entrainment region see especially FIGS. 2, 4 and 6 by drawing the ambient air 9 into the flow of fluid 10 being delivered along the fluid flow guide member 13. The higher speed fluid flow 10 creates a suction on the ambient air 9 in the entrainment region thereby further enhancing the technical function of the entrainment assembly 1 to ensure that the cut end of the web 22 is entrained in the overall airflow 9, 10 in the entrainment region. This prevents any risk of wrap around which is the major potential problem when the web 21 is cut during replacement of a core/shaft 5. The fluid flow delivery arrangement 11 extends laterally along all or part of the width of the web 21. The fluid outlet 12 extends laterally along all or part of the width of the web 21. The boundary layer of the laminar flow prevents the cut end of the web sticking to or contacting the surface of the fluid flow guide member.

Figure 1:
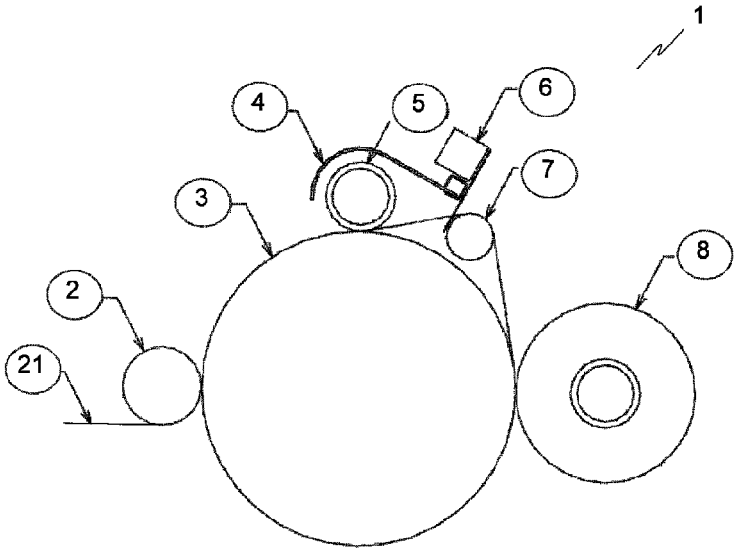
FIG. 1 is a schematic side view of a typical winder assembly with the assembly for entraining a cut end of a web in a fluid flow in an operational position.
Figure 2:
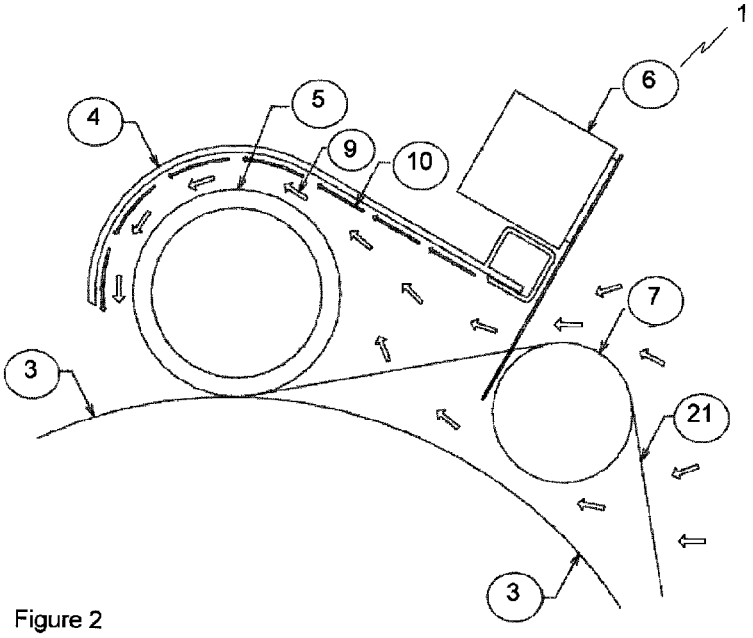
FIG. 2 is a detail view of part of a typical winder assembly with the assembly for entraining a cut end of a web in a fluid flow in an operational position.
Figure 3:
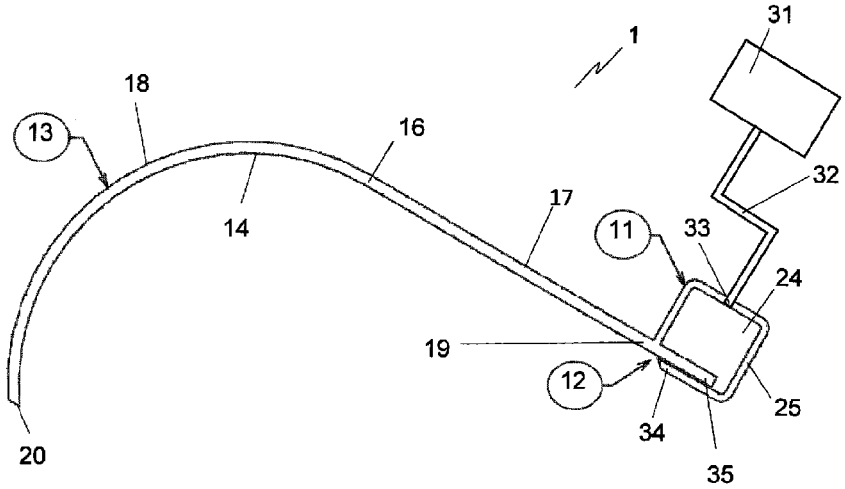
FIG. 3 is a detail view of a one piece assembly for entraining a cut end of a web in a fluid flow.
Figure 5:
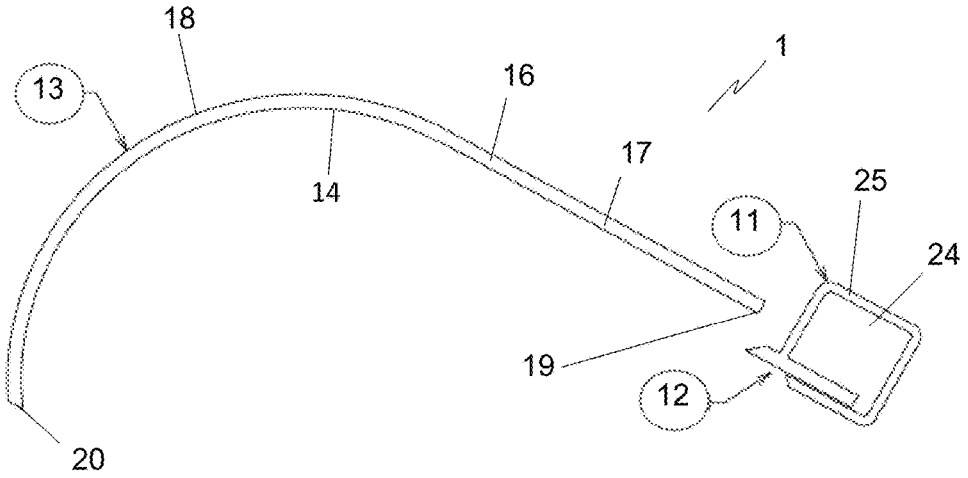
FIG. 5 is a separate detail view of the two piece assembly for entraining a cut end of a web in a fluid flow.
Figure 6:
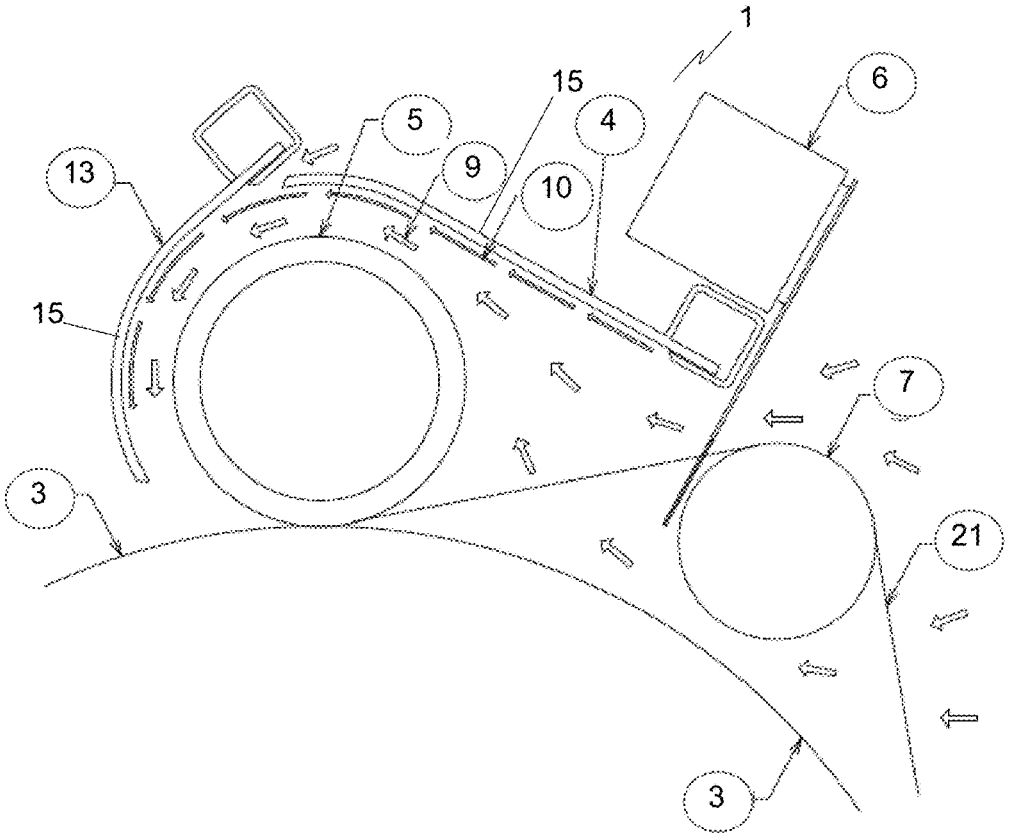
FIG. 6 is a detail view of an alternative arrangement where two assemblies are provided in a continuous arrangement for entraining a cut end of a web in a fluid flow in an operational position.

The reservoir 24 comprises an elongate housing 25 see FIGS. 3 and 5 defining a fluid chamber 24 extending laterally transverse the web 21. The elongate housing 25 has a tubular body 25 having at least one opening 12 for defining the fluid outlet. The elongate housing 25 comprises an open tubular body where the open ends 34, 35 see FIG. 3 of the tubular wall form an overlap defining a gap 12 there between for defining the fluid outlet 12. The mutually opposing overlapping walls of the opening 12 of the tubular body create a channel for aligning the outlet direction of the fluid flow 10 with the surface 14 of the fluid flow guide member 13.

A single assembly 1 for entraining a cut end of a web 22 in a fluid flow is capable of extending longitudinally along the length of the path of the entrained web from the web entrainment region to a web delivery region as illustrated in all drawings other than FIG. 6.

In an alternative arrangement illustrated in FIG. 6, two or more assemblies 1 for entraining a cut end of a web 22 in a fluid flow 9, 10 are provided spaced apart along the length of the path of the entrained web from the original web entrainment region to one further web entrainment region to the web delivery region. In this embodiment, the one further assembly 1 is located relative to the first assembly to ensure the fluid flow 9, 10 is essentially continuous.

The drawings illustrate a typical surface winder assembly 23 with automatic web transfer. This is only for illustration purposes as the invention can be implemented in any suitable type of winder/re-winder assembly. As the web 21 is cut, the web 21 is being transferred onto a new core/shaft 5 by applying air pressure to the air knife 11 with air flow guide member 13 directing the flow. As the air knife 11 blows a laminar flow of air 10 between the new core 5 and air guide 13, the high speed laminar air flow 10 entangles ambient air 9 from below and above the web lift idle roller 7. The cut off end of the web 22 is thereby entangled in the air stream 9, 10 and securely engaged and employed onto the new core 5. The air gap/outlet 12 can be applied to the whole width of the air knife 11 or in parts only. The air knife 11 and air flow guide member 13 can be the full width of the web, servicing multiple webs, or part thereof. The entrainment assembly 1 can be applied to both moving and stand still webs 21. Air for the air knife 11 can be supplied from a compressed air vessel connected to the air knife 11 with quick exhaust valves or similar method. In systems where low air pressure is adequate, ventilators or blowers can supply the air knife with air. The curved air flow guide 13 can be shortened, extended or otherwise alleviated/formed to allow it for further guiding the film web 22 around the core 5. The air knife 11 and air guide 13 can be moved as appropriate in any direction during roll transfer, or pivoting action, or articulation to facilitate the roll transfer. The shape and size of the air knife 11 and air guide 13 can be changed to suit specific winder and core size. The air knife 11 and guide 13 can be used without the Web Lift Idle Roller 7, by placing the air knife 11 close to the web 21 on the drum roller 3. As high speed air 10 exits the air knife 11 the entrained air 9 will lift the film web 21 off the drum roller 3 making it possible for the flying knife 6 to cut the web 21.

Figure 4:
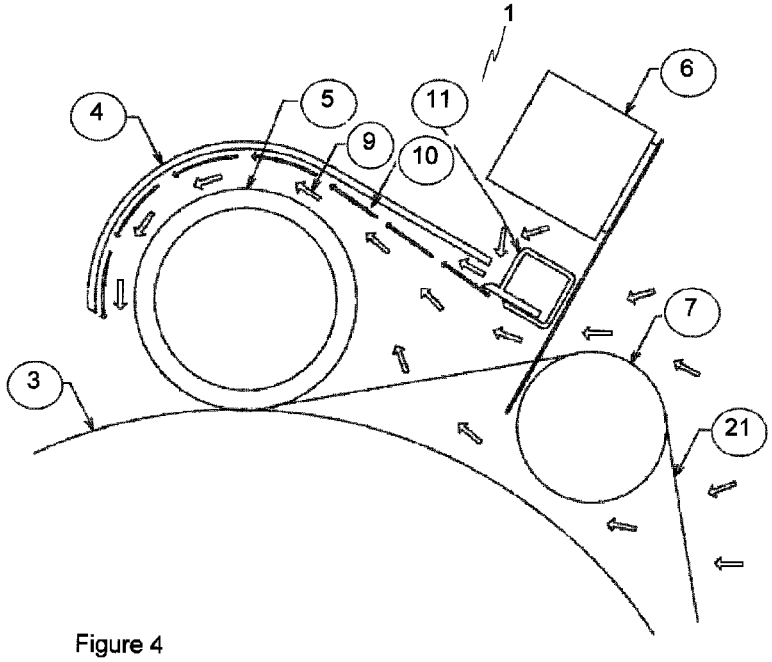
FIG. 4 is a detail view of a two piece assembly for entraining a cut end of a web in a fluid flow in an operational position.

Depending on winder application the air knife 11 and air guide 13 can be split into different parts to facilitate the winder and web cut off as shown in FIG. 4. It is in some cases beneficial to apply entrant ambient air 9 in specific places along the air guide 13. It is in some cases beneficial to use a full or part textured or perforated air guide 13.

FIG. 5 illustrates the same invention with air knife 11 and air guide 13 as two separate parts. The air knife 11 and air guide 13 can be separated in any place to accommodate specific winder and/or web material needs. FIG. 6 illustrates the same invention with two air knives 11 and two air guides 13 as separate parts. Air knife 11 and air guide 13 can ultimately be divided in to any numbers to facilitate specific winder and/or web material needs.

Figure 14:
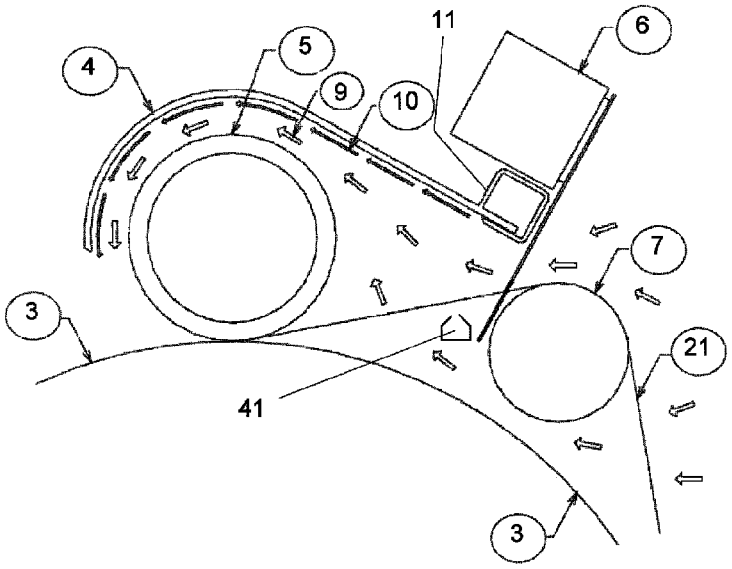
FIG. 14 illustrates a further embodiment of entraining assembly.

In a further embodiment of entrainment assembly illustrated in FIG. 14, a fluid flow delivery arrangement 41 is shown mountable in the space between the raised web 21 and the drum roller 3. This fluid flow delivery arrangement 41 may be used on its own as a replacement for the arrangement 11 or it may be utilized in combination with the arrangement 11.

FIG. 7 to FIG. 13 illustrates a side view of a step by step example of a winder roll transfer with the current invention. It should be noted that there are many different types of winders/re-winders and the illustrations are only a guide to illustrate the principle that can be utilized in all other types of winders, although the cycle and movements can differ.

Figure 9:
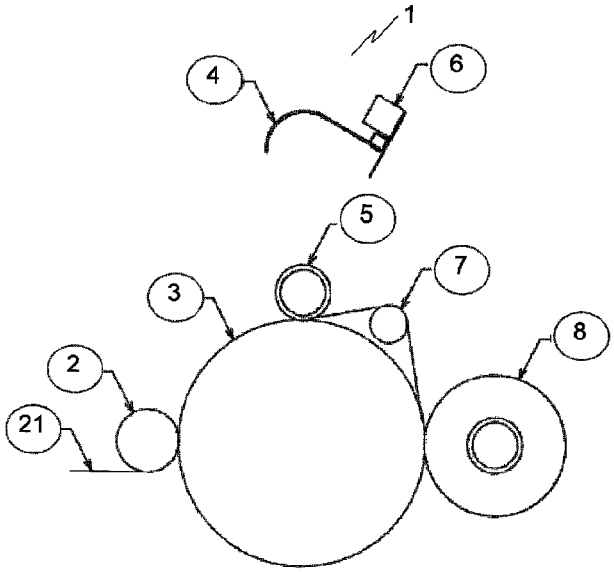
FIG. 9 illustrates a schematic side view of a third stage of the changeover process for winder cores/shafts using the entraining assembly of the present invention.
Figure 10:
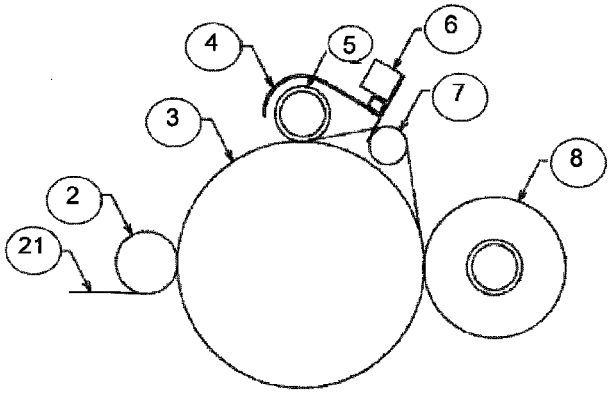
FIG. 10 illustrates a schematic side view of a fourth stage of the changeover process for winder cores/shafts using the entraining assembly of the present invention.
Figure 12:
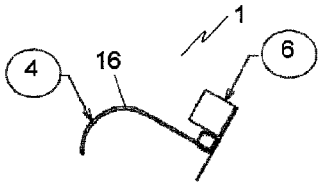
FIG. 12 illustrates a schematic side view of a sixth stage of the changeover process for winder cores/shafts using the entraining assembly of the present invention.
Figure 12:
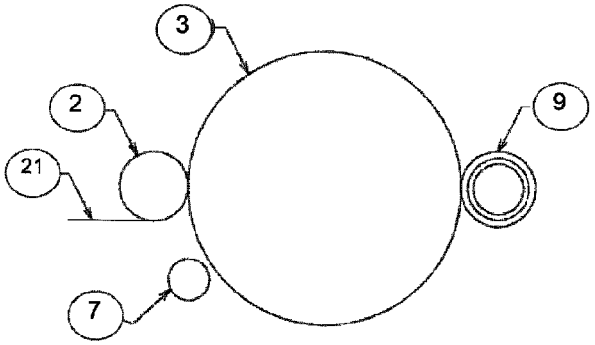
Figure 13:
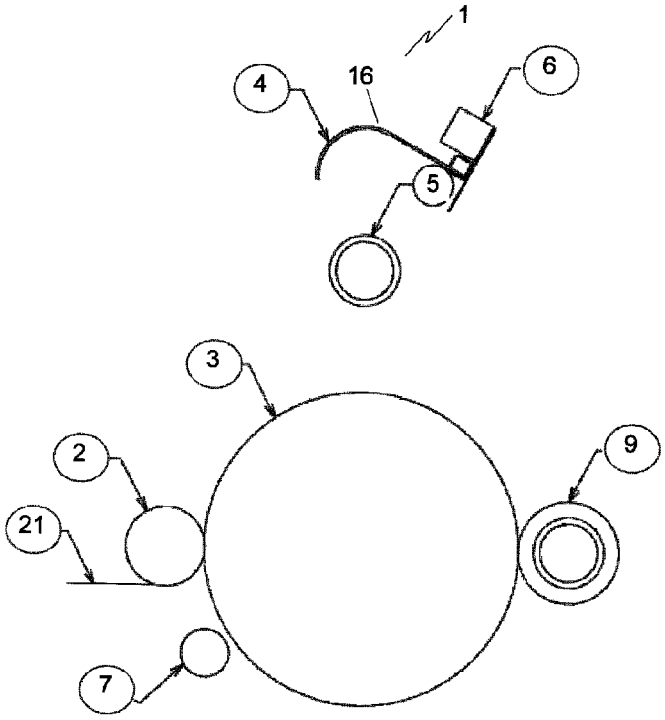
FIG. 13 illustrates a schematic side view of a seventh stage of the changeover process for winder cores/shafts using the entraining assembly of the present invention.

FIG. 7 illustrates the wind up position. In this position the first core and/or shaft 8 has a complete roll of the web wound thereon. The replacement core and/or shaft 5 is in an out of use position with the entrainment assembly 1. FIG. 8 illustrates the lay-on idle roller 2 disengage from drum-roller 3 to let a web lift idle roller 7 pass into position for web cutting. In FIG. 9, a new shaft and/or core 5, engages with drum-roller 3, spinning new shaft and/or core 5. A lay-on roller 2 moves back into position with drum roller 3. In FIG. 10 the assembly 1 comprising air knife 11, air guide 13 and flying knife 6 move into position for cut-off. In FIG. 11 the flying knife 6 cuts web 21 and air knife 11 and air guide 13 direct the cut off web 22 onto a new core/shaft 5. The timing of the flying knife 6 and air knife 11 depends on the web material 21. The timing of the flying knife 6 and air knife 11 should be adjustable to suit the specific web material. That said the amount and pressure of compressed air vary depending on web material. The duration of compressed air flowing through the air knife 11 varies depending on web material. The timing of compressed air flowing through the air knife 11 and the web cut off vary depending on the web material. In FIG. 12, a finished roll disengages with drum-roller 3 for pick up. Air knife 11, air guide 13 and flying knife 6 retracts to let a new shaft/core 5 with web pass into a normal winding position. In FIG. 13, a new shaft/shaft with core 5 is positioned in the winder, ready for the next roll change.

The air knife and air guide can be made of any material suitable, strong enough for the purpose, for example the "air knife" can be made of aluminium and the "air guide" can be made of steel. The air knife must be made of a material that safely can withstand the air pressure under use. The air guide can for example be made of plastic and the air knife can be made of extruded aluminium.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilized for realizing the invention in diverse forms thereof as defined in the appended claims.

The invention claimed is:

1. An assembly for entraining a cut end of a web in a fluid flow, the assembly comprising:

a knife means for cutting a web;

means for delivering a fluid flow proximal to an entrainment region where the web is cut, wherein the means for delivering a fluid flow comprises a reservoir for holding a volume of fluid and a fluid outlet means in fluid communication with the reservoir and the entrainment region; and means for guiding the fluid flow and an entrainable end of a cut web from the web entrainment region to a replacement web collection means, wherein the means for guiding the fluid flow and the entrainable end of the web comprises a fluid flow guide member, the fluid flow guide member having a substantially smooth surface for generating a laminar flow fluid flow with a boundary layer, wherein the fluid flow guide member is mounted proximal to the replacement web collection means in a web cutting operational position, the fluid flow guide member comprises a leading edge proximal to the web entrainment region where the web is cut and a trailing edge proximal to the replacement web collection means, an aft portion of the fluid flow guide member proximal to the trailing edge of the fluid flow guide member is curved to follow the circumference of the outer surface of the replacement web collection means, wherein the fluid outlet means is located proximal to the leading edge of the fluid flow guide member where the web is cut, and wherein the replacement web collection means is disposed in the fluid flow and has a curved surface to create a coanda effect on the fluid flow drawing the fluid flow towards the curved surface of the replacement web collection means wherein the fluid flow exiting the fluid outlet means creates a venturi effect on the ambient air around the entrainment region by drawing the ambient air into the flow of fluid being delivered along the fluid flow guide means.

2. The assembly as claimed in claim 1, wherein the surface of the fluid flow guide member at least initially extends away from an uncut web in the same or similar direction as the direction of flow of the fluid.

3. The assembly as claimed in claim 2, wherein the elongate housing comprises a tubular body having at least one opening for defining the fluid outlet means.

4. The assembly as claimed in claim 2, wherein the elongate housing comprises an open tubular body where the open ends of the tubular wall form an overlap defining a gap there between for defining the fluid outlet means.

5. The assembly as claimed in claim 1, wherein the fluid flow guide member comprises at least one panel or sheet.

6. The assembly as claimed in claim 1, wherein the fluid flow guide member extends laterally along all or part of the width of the web.

7. The assembly as claimed in claim 1, wherein a forward portion of the fluid flow guide member proximal to a leading edge of the fluid flow guide member is planar.

8. The assembly as claimed in claim 1, wherein the aft portion of the fluid flow guide member is arcuate and most preferably part cylindrical.

9. The assembly as claimed in claim 1, wherein the end of the fluid flow guide member has a sharp edge for separation of fluid flow from the fluid flow guide member.

10. The assembly as claimed in claim 1, wherein the means for delivering a fluid flow proximal to the entrainment region where a web is cut comprises a fluid knife.

11. The assembly as claimed in claim 1, wherein the fluid flow delivery means comprises means for urging the fluid from the reservoir out through the fluid outlet means.

12. The assembly as claimed in claim 1, wherein the fluid outlet means is adapted to direct the fluid along the fluid flow guide means.

13. The assembly as claimed in claim 1, wherein the fluid outlet means comprise one or more slots or slits or gaps or vents or valves.

14. The assembly as claimed in claim 1, wherein the fluid outlet means comprises an elongated slit extending laterally along the length of the fluid flow delivery means.

15. The assembly as claimed in claim 1, wherein the fluid outlet means is located proximal to the web in the web cutting operational position.

16. The assembly as claimed in claim 1, wherein the fluid outlet means is located proximal to the cutting position of the web.

17. The assembly as claimed in claim 1, wherein the fluid outlet means delivers a laminar flow of fluid along the fluid flow guide means.

18. The assembly as claimed in claim 1, wherein the reservoir comprises an elongate housing defining a fluid chamber extending laterally transverse the web.

19. The assembly as claimed in claim 1, wherein a single assembly for entraining a cut end of a web in a fluid flow is capable of extending longitudinally along the length of the path of the entrained web from the web entrainment region to a web delivery region or wherein two or more assemblies for entraining a cut end of a web in a fluid flow are provided spaced apart along the length of the path of the entrained web from the original web entrainment region to one or more further web entrainment regions to the web delivery region.

20. A winder assembly comprising an assembly for entraining a cut end of a web in a fluid flow as claimed in claim 1.

* * * * *